US007575191B2

(12) United States Patent
Layton

(10) Patent No.: US 7,575,191 B2
(45) Date of Patent: Aug. 18, 2009

(54) BINARY OPTICS SAL SEEKER (BOSS)

(75) Inventor: Allen C. Layton, Windermere, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 130 days.

(21) Appl. No.: 11/340,714

(22) Filed: Jan. 27, 2006

(65) Prior Publication Data

US 2007/0187546 A1 Aug. 16, 2007

(51) Int. Cl.
*F41G 7/00* (2006.01)
*F42B 15/00* (2006.01)

(52) U.S. Cl. ..... 244/3.16; 244/3.1; 244/3.15

(58) Field of Classification Search ..... 244/3.1–3.3; 342/62; 356/3, 4.01, 5.01; 250/200, 216, 250/234; 89/1.11
See application file for complete search history.

(56) References Cited

U.S. PATENT DOCUMENTS

| | | | | |
|---|---|---|---|---|
| 3,212,083 | A * | 10/1965 | Hinchman | 244/3.11 |
| 3,841,585 | A * | 10/1974 | Evers-Euterneck | 244/3.15 |
| 4,100,545 | A * | 7/1978 | Tabourier | 244/3.14 |
| 4,143,835 | A * | 3/1979 | Jennings et al. | 244/3.11 |
| 4,383,663 | A * | 5/1983 | Nichols | 244/3.16 |
| 4,558,836 | A * | 12/1985 | Kriegesmann | 244/3.11 |
| 5,200,606 | A * | 4/1993 | Krasutsky et al. | 356/5.01 |
| 5,268,691 | A * | 12/1993 | Murphy | 244/3.13 |
| 5,281,973 | A * | 1/1994 | Murphy et al. | 244/3.13 |
| 5,917,442 | A * | 6/1999 | Manoogian | 244/3.14 |
| 6,111,241 | A | 8/2000 | English et al. | |
| 6,262,800 | B1 * | 7/2001 | Minor | 244/3.13 |
| 6,919,840 | B2 * | 7/2005 | Friedrich et al. | 244/3.15 |
| 7,183,966 | B1 * | 2/2007 | Schramek et al. | 244/3.15 |
| 7,185,845 | B1 * | 3/2007 | Hartman et al. | 244/3.16 |
| 7,276,681 | B2 * | 10/2007 | Alexander et al. | 244/3.13 |

FOREIGN PATENT DOCUMENTS

FR 2659731 A1 * 9/1991

OTHER PUBLICATIONS

Captain A.W. Lange, "Hellfire: Getting the Most from a Lethal Missile System"; Jan.-Feb. 1998 issue of the magazine Armor; pp. 25-30.*

Photonics Spectra, Laurin Publishing, Jun. 2004, "Light Tamers, Engineered Microlens Arrays Provide New Control for Display and Lighting Applications," Tasso R.M. Sales et al., RPC Photonics Inc.

* cited by examiner

*Primary Examiner*—Bernarr E Gregory
(74) *Attorney, Agent, or Firm*—Birch, Stewart, Kolasch & Birch, LLP

(57) ABSTRACT

The present invention relates to a strap down SAL seeker that includes an optical system having an engineered diffuser for transforming a laser spot into a uniform distribution of optical energy with a predetermined shape. The predetermined shape is preferably a square "top hat" or uniform scatter pattern. The SAL seeker further includes a silicon quad detector, having a focal plane defined by at least two axes. The detector is operatively associated with the engineered diffuser, and it generates signals indicative of the position of the optical energy with respect to the focal plane of the detector.

19 Claims, 4 Drawing Sheets

BINARY OPTICS SAL SEEKER (BOSS)

BACKGROUND OF THE INVENTION

1. Field of the Invention

The present invention relates generally to a SAL seeker, and more specifically to an engineered diffuser utilized in conjunction with a strap down SAL seeker or a velocity pursuit SAL seeker.

2. Description of the Related Art

Semi-active laser ("SAL") seekers are well known in the art, and a representative example is described in U.S. Pat. No. 6,262,800, entitled "Dual Mode Semi-Active Laser/Laser Radar Seeker", by Lewis Minor, and assigned to Lockheed Martin Corporation, the assignee of the present application. The '800 patent describes a marking and guidance system for use on military aircraft to support ground operations. With a SAL seeker system, a narrow laser beam is produced and transmitted toward a target from a laser designator aircraft or from a forward observer located on the ground. The operator of the laser designator directs the laser illumination towards a selected target, thereby designating the target.

The laser source is located remote from the target energy transmitter. The SAL seeker, which is disposed on the missile or other weapon, detects the laser illumination reflected from the target. The SAL seeker system includes processing equipment for generating guidance commands to the missile derived from the sensed laser illumination as it is reflected from the target to guide the missile or weapon to the target. Pilots or other users utilize equipment similar to SAL seeker system to identify a target.

SAL seeker systems typically include a detector sensitive to the laser wavelength and a two axis gimbal system that allows the SAL seeker to have a wider field of regard ("FOR"). It should be noted that a sensor has a field of view ("FOV"), but gimbals provide a non strap down seeker with a wide FOR. For a strap down seeker, FOR=FOV. SAL seekers having a gimbal system are well known in the art.

In order to reduce the cost and simplify the complexity of SAL seekers having gimbals, the United States military wants to develop a strap down SAL seeker that eliminates the gimbal system. The elimination of the gimbal system advantageously reduces the complexity and cost of the SAL seeker, but it also disadvantageously reduces the FOR. New strap down SAL seekers, without a gimbal system, are being proposed for many missile applications, because they are relatively small and inexpensive. SAL seekers, however, require a relatively large field of regard, relatively fast optics, anti-scintillation capability and small physical size. The current optical designs that attempt to meet these conflicting requirements, result in a blur spot that is extremely non-uniform. In addition to strap down SAL seekers, there is also a "birdie" or velocity pursuit SAL seeker. This type of seeker has passive (non driven) gimbals that allow the seeker to align to its velocity vector the way a badminton shuttlecock or birdie aligns to its velocity vector. This type of seeker is currently used in laser guided bombs provided by various vendors. Because this type of seeker has passive gimbals, it is not considered to be a strap down seeker, but it has similar requirements and issues as a strap down seeker.

In addition, atmospheric scintillation and uniformity problems further aggravate the performance of SAL seekers. Air turbulence near the ground is a primary source of atmospheric scintillation, and the air turbulence makes it appear to the SAL seeker that the laser spot is jumping or moving randomly. The spot uniformity problem further compounds the situation, because the laser spot typically does not have a uniform energy distribution. A non-uniform distribution of laser energy means that the laser spot does not appear as a well-defined spot of illumination to the detector, and the non-uniformity complicates image processing of the laser spot.

Previous solutions to the scintillation problem have been expensive (use of a fiber optic faceplate) or have produced poor spot uniformity (use of a spherical distortion lens). Moreover, the previous solutions to reduce the scintillation have actually aggravated the uniformity problem. For example, the use of carefully designed aberrations in the optics to reduce scintillation produce significant spot non-uniformity and a non-linear response in a strap down seeker.

Accordingly, there is a need for a SAL seeker that has a relatively wide FOV and overcomes the atmospheric scintillation and spot uniformity problems associated with SAL Seekers, without resorting to the relatively expensive and less satisfactory solutions of the prior art.

SUMMARY OF THE INVENTION

The method and system of the present invention relates to a strap down SAL seeker having novel optical components that overcomes the atmospheric scintillation and spot uniformity problems of a conventional SAL seeker. The SAL seeker of the present invention includes an engineered diffuser to solve spot uniformity and atmospheric scintillation problems while maintaining compatibility with fast optics, a large FOV and compact design. Engineered diffusers are a new type of computer generated optical element made with, for example, laser writers that cannot be made using normal optical fabrication techniques. The engineered diffuser can produce an arbitrary distribution of energy. Preferably, a square distribution, with uniform energy density over the entire square area, is selected for use with the strap down seeker of the present invention.

DETAILED DESCRIPTION OF THE INVENTION

The present invention relates to a SAL seeker having an engineered diffuser disposed at its aperture. Engineered diffusers are a new class of optical elements that are designed and generated by a computer. The computer is used to calculate the shapes of various microlenses which are formed in a substrate using a laser. A radius of curvature, conic constant, and aspheric coefficients define each microlens element of the engineered diffuser. At the normal SAL wavelength of 1.06 um, the engineered diffuser is computer generated, and it is formed on an inexpensive plastic disk that can be replicated in production quantities at a relatively low cost. The engineered diffuser of the present invention is preferably disposed at the entrance aperture of the SAL seeker, and the engineered diffuser distributes the incoming laser energy in a predetermined distribution or shape that is projected onto the detector.

Figure 1:
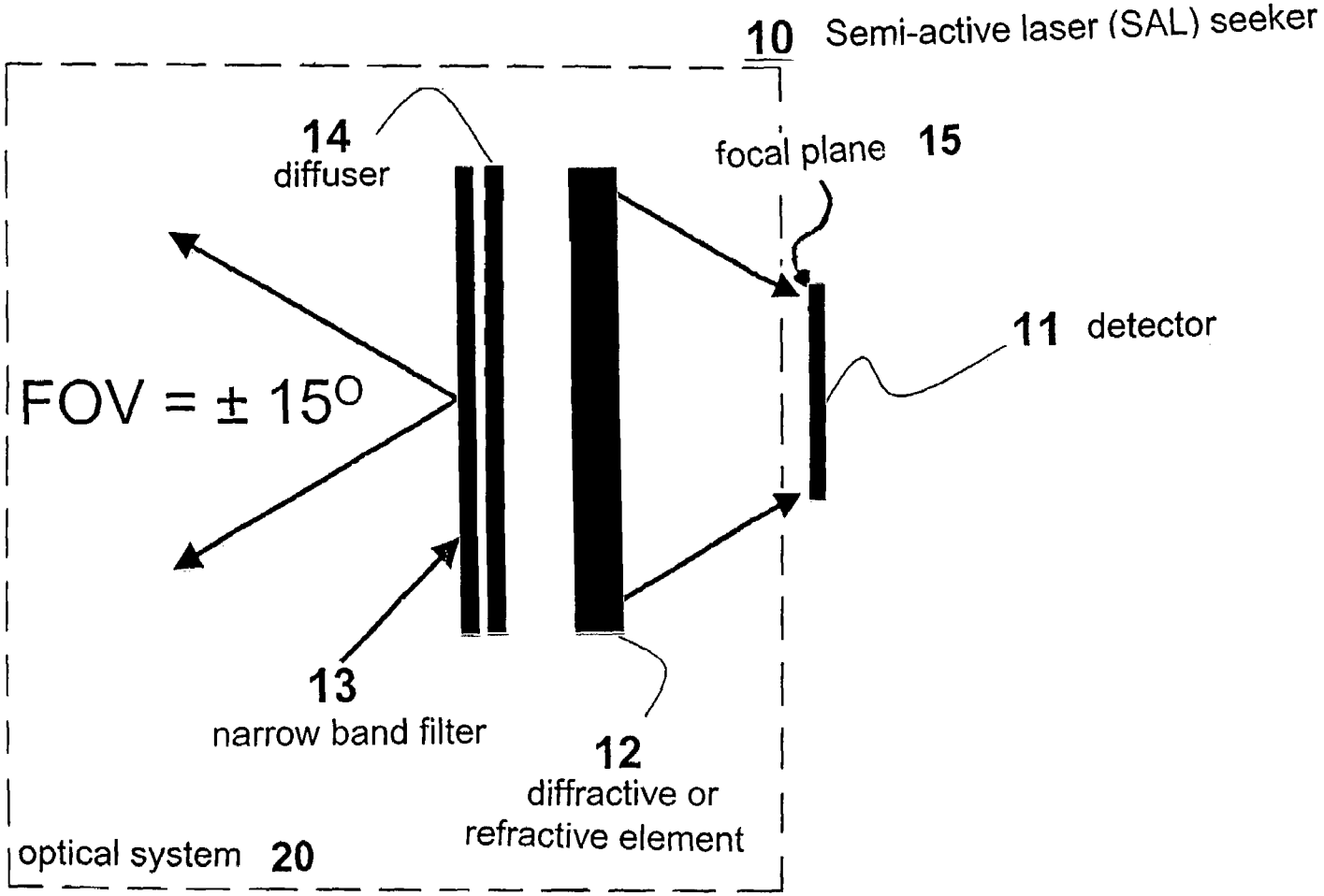
FIG. 1 is an illustration of the SAL seeker of the present invention.

Referring now to FIG. 1, a schematic diagram of the SAL seeker 10 of the present invention is provided. The SAL seeker 10 preferably includes a silicon quad detector 11 upon which the image of the laser spot is formed. The light from the laser enters the SAL seeker 10 through a narrow band optical filter 13 which preferably passes optical wavelengths of 1.064 μm. The FOV of the SAL seeker 10 is, for example, in the range of + or −15 degrees. It should be noted, however, that the FOV of ±15 degrees was desired for a particular application. Other applications could result in a larger or smaller FOV. The filtered light from the optical filter 13 passes through the engineered diffuser 14. The engineered diffuser 14 is preferably of a type sold by RPC Photonics, Inc., 330 Clay Rd., Rochester, N.Y. 14623. It is possible to obtain diffusers from other vendors who can make equivalent engineered diffusers. The engineered diffuser 14 distributes the light in a uniform pattern which is described in greater detail below. It is possible to place the filter 13 before or after the diffuser 14. Either a diffractive or refractive optical element 12 is preferably positioned between the engineered diffuser 14 and the silicon quad detector 11 to focus the laser energy on the quad cell. It is also possible and fairly common to build an optical element that is both refractive and diffractive. Other prior art SAL seekers have used reflective optics that neither refract nor diffract the laser energy. The engineered diffuser 14 and optical element 12 are positioned so that the diffused light strikes the focal plane of the silicon quad detector 11.

Figure 2:
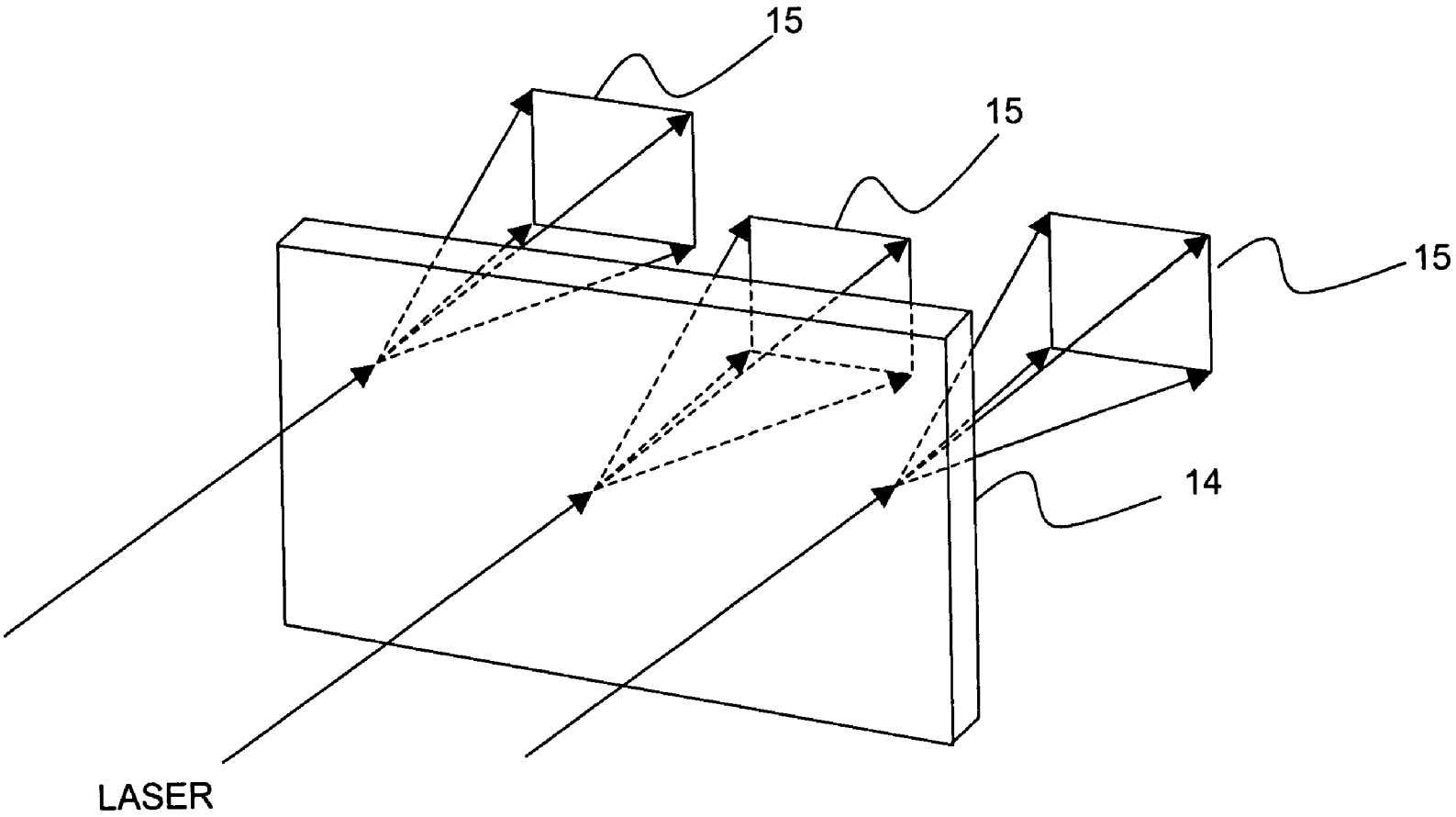
FIG. 2 is an illustration of the engineered diffuser of the present invention.

Referring now to FIG. 2, an illustration of the engineered diffuser 14 is provided. The engineered diffuser 14 is a high-performance diffuser with advanced light-control capabilities. The engineered diffuser homogenizes the input illumination of the laser beam, spreads the laser beam within a specified divergence angle and, controls the intensity profile of the diffused laser beam. In FIG. 2, the diffused laser is distributed in a preferred square "top hat" or uniform scatter pattern 15.

Unlike conventional diffusers, an engineered diffuser can implement various arbitrary intensity profiles. If a flat or uniform intensity profile is desired, the engineered diffuser can maintain constant intensity over a certain angular range thus providing uniform illumination. The engineered diffuser is also capable of controlling the spatial distribution of light. Ordinary diffusers spread light within a certain cone defined by the strength of the diffuser. An engineered diffuser, however, enables arbitrary control of spatial light distribution. The engineered diffuser is in effect a beam shaper that can distribute light in complex ways to suit different applications. For example, an engineered diffuser can distribute light in many shapes including a square, a circle or an ellipse.

The engineered diffuser 14 can be engineered to produce various other energy distributions in addition to the square "top hat" scatter pattern 15 on the detector 11 of the seeker 10. The "top hat" or flat energy distribution, however, provides a desirable uniform response. The square distribution also provides a linear response to changes in angle, whereas a circular distribution is non linear. As can be appreciated from FIG. 2, the engineered diffuser 14 distributes energy from each point in the aperture of the seeker 10 to each point in the energy distribution or scatter pattern 15. The scatter pattern 15 maps energy from each point in the aperture to each point on the focal plane to eliminate the scintillation effects associated with non uniform aperture illumination in prior art SAL seekers.

Figures 3A, 3B, 3C, 3D, 3E:
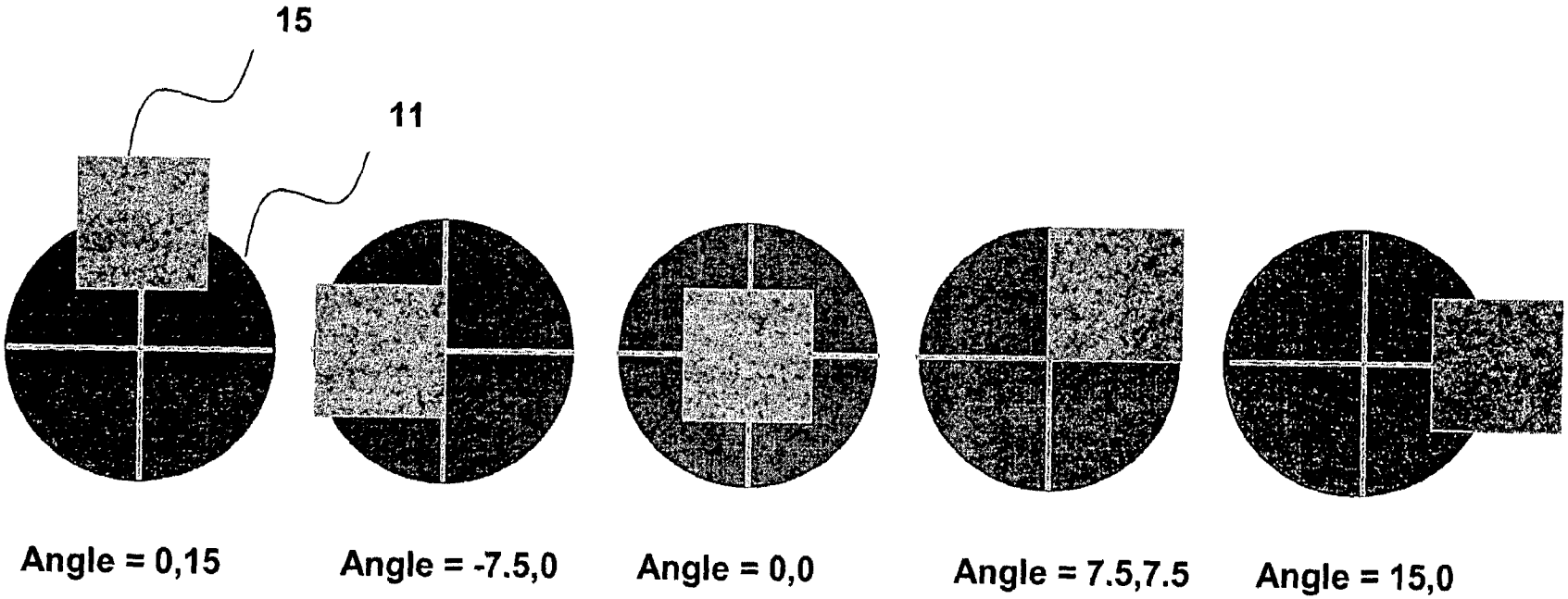
FIGS. 3A-3E are illustrations of the square distributions of light from the engineered diffuser projected onto the circular focal plane of a detector.

Referring now to FIGS. 3A-3E, there is an illustration of the circular focal plane of the silicon quad detector 11 and a square distribution of light or scatter pattern 15 with uniform energy density over the square scatter pattern 15. The circular focal plane of the detector 11 includes four quadrants which are defined by a vertical axis and a horizontal axis. The square scatter pattern 15 is the result of the laser spot having passed through the diffuser 14 and then being focused on the focal plane by the optical element 12. In FIG. 3A, the square distribution of light 15 is centered along the vertical axis of the detector 11, and it is disposed 0 degrees with respect to the vertical axis. In FIG. 3A the square distribution of light 15 is disposed at 15 degrees above the horizontal axis. FIGS. 3B-3E illustrate a few of the continuum of other possible locations of the square distribution of light 15 with respect to the axes of the circular focal plane of the detector 11.

Figure 4:
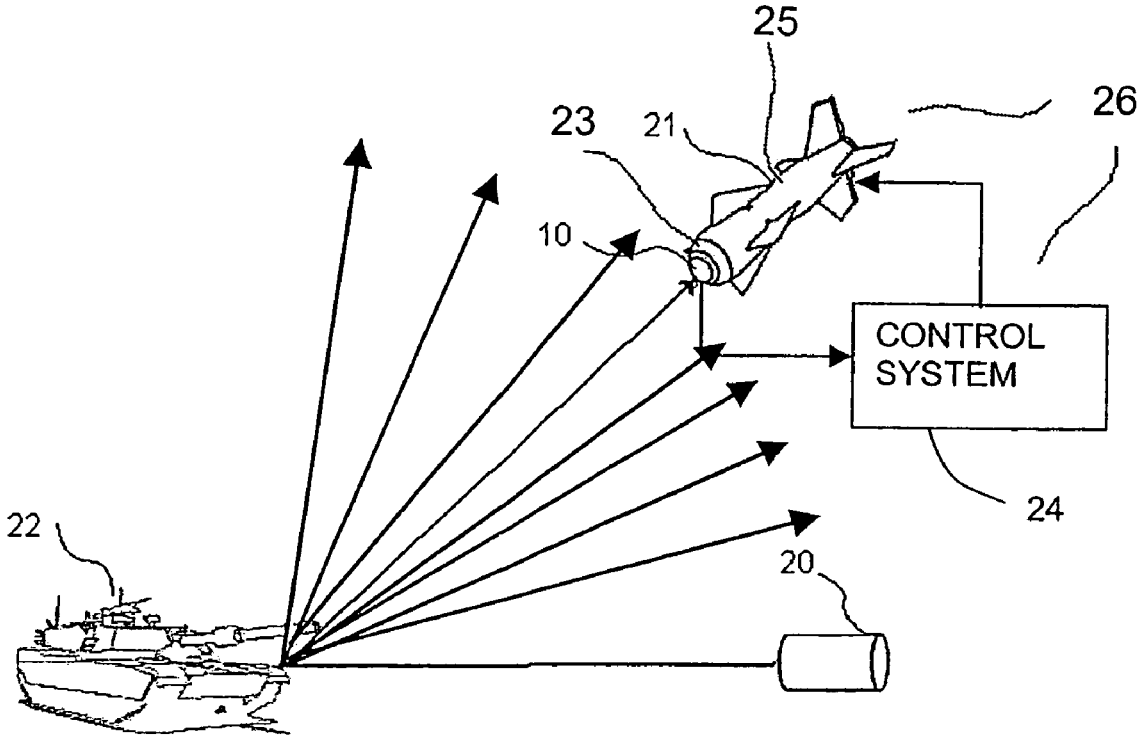
FIG. 4 is an illustration of a target and a missile equipped with the present invention.

Referring now to FIG. 4, an illustration of a target 22 and a missile 21 equipped with the SAL seeker 10 of present invention is provided. A laser source 20 generates a beam of light that is scattered by the target 22, and the scattered laser energy is seen by the SAL seeker 10 located onboard the missile 21. The SAL seeker of the present invention can be adapted for use with a missile, a guided bomb dropped from an aircraft or with any other type of guided munition or device.

The position of the square pattern 15 on the focal plane of the quad detector 11 is used by a control system 24 to generate control signals for the missile 21 or weapon that employs the strap down SAL seeker 10 of the present invention. It should be noted that at any point in time, there is only one square pattern. For example, when the detector 11 of the missile 21 equipped with the SAL seeker 10 sees the square pattern 15 of FIG. 3A, the SAL seeker generates signals indicating that the missile is aligned with the reflected laser beam along the vertical axis of the detector 11 and the target 22, and that the missile 21 is aimed 15 degrees below the horizontal axis of the detector and the target. It should also be noted that the lens reverses the error—up is down and left is right. The control system 24 of the missile 21 responds to the signals from the SAL seeker 10, and the control system 24 generates control signals that cause the control surfaces of the missile 21 to raise the aim of the missile, in order to align the square scatter pattern 15 with the horizontal axis of the detector 11. The control system 24 continuously generates control signals based upon the location of the square scatter pattern 15 with respect to axes of the detector 11. Once the missile 21 and the strap down SAL seeker 10 are correctly aligned with the target 22, the detector 11 sees the square pattern 15 centered on the vertical and horizontal axes of the detector 11 as depicted in FIG. 3C. The control signals associated with FIGS. 3A-3E are generated continuously until the missile 21 strikes the target 22 or the laser designator terminates operation.

In summary, the present invention provides a single, inexpensive optical element that solves both the scintillation problem and the spot uniformity problem of the strap down SAL seeker 10. The engineered diffuser 14 of the present invention eliminates the need for a fiber optic faceplate, thereby substantially reducing the cost of the SAL seeker, because a fiber optic faceplate needs to be mounted in close proximity to the detector. Lastly, the present invention improves performance, because no other known technique can eliminate scintillation while maintaining uniformity of response over the large FOV required by a strap down seeker. Note: The fiber optic face plate is not effective for the large FOV requirements of a strap down seeker. They are used in seekers with gimbals that have smaller FOV requirements and use the gimbals to achieve a large FOR.

I claim:

1. A semi-active laser (SAL) seeker, comprising:

an optical system having a diffuser that homogenizes input illumination of incident laser radiation, spreads said incident radiation within a predetermined divergence angle and according to a predetermined shape, and establishes a predetermined intensity profile for said incident radiation; and a detector, having a focal plane defined by at least two axes, operatively associated with the diffuser, such that when the homogenized and spread incident radiation is projected onto said detector, the detector generates signals indicative of the position of the incident radiation with respect to the axes of the focal plane.

2. The SAL seeker according to claim 1 wherein the SAL seeker is either a strapped down SAL or a velocity pursuit SAL seeker.

3. The seeker according to c1aim 1, wherein the predetermined shape is a square pattern.

4. The SAL seeker of claim 1, wherein said SAL seeker is disposed in a guided weapon such that the signals from the SAL seeker are applied to a control system that directs the weapon to a target based on the position of the incident radiation with respect to the axes of the focal plane.

5. The SAL seeker of claim 4 wherein the guided weapon is a bomb dropped from an aircraft.

6. The SAL seeker of claim 1, further comprising:

a narrow band optical filter disposed between the incident laser radiation and the diffuser; and a diffractive element disposed between the diffuser and the detector.

7. The SAL seeker of claim 1, further comprising:

a narrow band optical filter disposed between the incident laser radiation and the diffuser; and a refractive element disposed between the diffuser and the detector.

8. A semi-active laser (SAL) seeker, comprising:

an optical system having a diffuser for transforming laser energy into a uniform distribution of optical energy having a predetermined shape; and a detector, having a focal plane defined by at least two axes, operatively associated with the diffuser, for generating signals indicative of the position of the optical energy with respect to the axes of the focal plane, wherein the SAL seeker is a strapped down SAL seeker that includes a narrow band optical filter disposed between the incoming laser illumination and the diffuser; and a diffractive element disposed between the diffuser and the detector.

9. A semi-active laser (SAL) seeker, comprising:

an optical system having a diffuser for transforming laser energy into a uniform distribution of optical energy having a predetermined shape; and a detector, having a focal plane defined by at least two axes, operatively associated with the diffuser, for generating signals indicative of the position of the optical energy with respect to the axes of the focal plane, wherein the SAL seeker is a strapped down SAL seeker that includes a narrow band optical filter disposed between the incoming laser illumination and the diffuser; and a refractive element disposed between the diffuser and the detector.

10. A method of locating and tracking a laser signal using a semi-active laser (SAL) seeker, comprising:

receiving, as input, incident laser radiation;

diffusing said incident laser radiation with a diffuser, wherein diffusing includes:

homogenizing and input illumination of said incident radiation, spreading said incident radiation within a predetermined divergence angle and according to a predetermined shape, and establishing a predetermined intensity profile for said incident radiation;

projecting, onto a focal plane defined by at least two axes and operatively associated with the diffuser, the diffused incident laser radiation; and detecting the position of the projected, diffused incident laser radiation with respect to the axes of the focal plane.

11. The method according to claim 10 wherein the predetermined shape is a square pattern.

12. The method of claim 10, further comprising filtering said incident laser radiation before diffusing; and wherein said projecting includes diffracting said diffused incident laser radiation.

13. The method of claim 10, further comprising filtering said incident laser radiation before diffusing; and wherein said projecting includes refracting said diffusing incident laser radiation.

14. The method of claim 10, further comprising directing a guided weapon to a source of said laser signal based on the position of the projected, diffused incident laser radiation with respect to the axes of the focal plane.

15. A method for operating a strap down semi-active laser (SAL) seeker, comprising:

imaging a laser spot;

transforming the laser spot into a uniform distribution of optical energy having a predetermined shape with a diffuser;

detecting on a focal plane, defined by at least two axes and operatively associated with the diffuser, the position of the optical energy with respect to the axes of the focal plane;

filtering the incoming laser spot before transforming the laser spot with the diffuser; and diffracting the predetermined shape spot before it is detected.

16. A method for operating a strap down semi-active laser (SAL) seeker, comprising:

imaging a laser spot;

transforming the laser spot into a uniform distribution of optical energy having a predetermined shape with a diffuser;

detecting on a focal plane, defined by at least two axes and operatively associated with the diffuser, the position of the optical energy with respect to the axes of the focal plane;

filtering the incoming laser spot before transforming the laser spot with the diffuser; and refracting the predetermined shape spot before it is detected.

17. A missile system, comprising:

an airframe;

control mechanism for guiding the airframe;

a control system for controlling the control mechanism a strap down semi-active laser (SAL) seeker disposed on the airframe, the strap down SAL seeker including;

an optical system having a diffuser for transforming a laser spot into a uniform distribution of optical energy having a predetermined shape; and a detector, having a focal plane defined by at least two axes, operatively associated with the diffuser, for generating signals indicative of the position of the optical energy with respect to the axes of the focal plane, wherein the strap down SAL seeker includes a narrow band optical filter disposed between the incoming laser illumination and the diffuser; and a diffractive element disposed between the diffuser and the detector.

18. A missile system, comprising:

an airframe;

control mechanism for guiding the airframe;

a control system for controlling the control mechanism a strap down semi-active laser (SAL) seeker disposed on the airframe, the strap down SAL seeker including;

an optical system having a diffuser for transforming a laser spot into a uniform distribution of optical energy having a predetermined shape; and a detector, having a focal plane defined by at least two axes, operatively associated with the diffuser, for generating signals indicative of the position of the optical energy with respect to the axes of the focal plane, wherein the strap down SAL seeker includes a narrow band optical filter disposed between the incoming laser illumination and the diffuser; and a refractive element disposed between the diffuser and the detector.

19. A missile system, comprising:

an airframe;

control mechanism for guiding the airframe;

a control system for controlling the control mechanism;

a strap down semi-active laser (SAL) seeker disposed on the airframe, the strap down SAL seeker including;

an optical system having a narrow band optical filter for filtering incoming illumination;

a diffuser for transforming incoming illumination in the form of a laser spot into a uniform distribution of optical energy having a square shape;

an optical element that either diffracts or refracts the optical energy from the diffuser; and a detector, having a focal plane defined by at least two axes, operatively associated with the diffuser, for generating signals indicative of the position of the square shaped optical energy with respect to the axes of the focal plane;

wherein the SAL seeker is responsive to a laser beam that is generated by a laser designator and is reflected from a target, in order to generate signals for the control system which generates the control signals to guide the missile to the target.

* * * * *